US007736251B2

(12) United States Patent
Rogers et al.

(10) Patent No.: US 7,736,251 B2
(45) Date of Patent: Jun. 15, 2010

(54) LACROSSE STICK

(75) Inventors: David Rogers, Boston, MA (US); Ed Hall, North Marshfield, MA (US); Darwin Keith-Lucas, Boston, MA (US)

(73) Assignee: Quikstick Lacrosse, LLC, Duxbury, MA (US)

( * ) Notice: Subject to any disclaimer, the term of this patent is extended or adjusted under 35 U.S.C. 154(b) by 975 days.

(21) Appl. No.: 10/900,043

(22) Filed: Jul. 26, 2004

(65) Prior Publication Data

US 2006/0019777 A1 Jan. 26, 2006

(51) Int. Cl.
*A63B 59/02* (2006.01)
*A63B 65/12* (2006.01)

(52) U.S. Cl. ..... 473/513; D21/724; 473/505; 473/512

(58) Field of Classification Search ..... 473/512, 473/513, 505; D21/724
See application file for complete search history.

(56) References Cited

U.S. PATENT DOCUMENTS

| | | | |
|---|---|---|---|
| 891,813 | A | 6/1908 | Ceel |
| 1,459,389 | A | 6/1923 | Brown |
| 2,039,138 | A | 4/1936 | Auer |
| 2,142,527 | A | 1/1939 | Pool |
| 2,508,519 | A | 5/1950 | Jay |
| 2,710,753 | A | 6/1955 | Lockwood |
| 3,473,806 | A | 10/1969 | Patterson |
| 3,507,495 | A | 4/1970 | Tucker et al. |
| 3,692,609 | A | 9/1972 | Eckes |
| 3,702,702 | A | 11/1972 | Hoult |
| 3,910,578 | A | 10/1975 | Brine, Jr. |
| 3,961,790 | A | 6/1976 | Milligan |
| 3,982,760 | A | 9/1976 | Tiitola |
| 4,037,841 | A | 7/1977 | Lewis, Jr. |
| 4,059,269 | A | 11/1977 | Tiitola |
| 4,076,240 | A | 2/1978 | Haddad |
| 4,086,115 | A | 4/1978 | Sweet, Jr. et al. |
| 4,134,587 | A | 1/1979 | Diederich |
| 4,159,114 | A | 6/1979 | Ardell et al. |
| 4,172,594 | A | 10/1979 | Diederich |
| 4,180,413 | A | 12/1979 | Diederich |
| 4,200,479 | A | 4/1980 | Ardell et al. |
| 4,206,918 | A | 6/1980 | Lewis, Jr. |
| 4,340,226 | A | 7/1982 | Haines |

(Continued)

FOREIGN PATENT DOCUMENTS

CA 0342045 * 10/1932

(Continued)

OTHER PUBLICATIONS

International Search Report and Written Opinion for International Application No. PCT/US05/026346, mailed from the International Searching Authority on Nov. 3, 2005. (7 pgs.).

(Continued)

*Primary Examiner*—Gene Kim
*Assistant Examiner*—M Chambers
(74) *Attorney, Agent, or Firm*—Goodwin Procter LLP

(57) ABSTRACT

A lacrosse stick includes a flared (e.g., forked) end and a flexible head frame adapted to receive a mesh thereon.

24 Claims, 13 Drawing Sheets

U.S. PATENT DOCUMENTS 4,358,113 A 11/1982 McKinnon et al.
4,358,117 A 11/1982 Deutsch
4,361,325 A 11/1982 Jansen
4,399,992 A 8/1983 Molitor
4,451,041 A 5/1984 Hayashi et al.
4,488,721 A 12/1984 Franck et al.
4,591,155 A 5/1986 Adachi
4,600,192 A 7/1986 Adachi
4,655,455 A * 4/1987 Kurusu ..... 473/548
4,725,059 A 2/1988 Du Gardin et al.
4,739,994 A 4/1988 Lewis, Jr.
4,915,382 A * 4/1990 Madsen ..... 473/531
4,940,243 A 7/1990 Tucker et al.
4,968,032 A 11/1990 Redekop
5,002,278 A * 3/1991 Costa ..... 473/548
5,007,652 A 4/1991 Tucker et al.
5,048,843 A 9/1991 Dorfi et al.
5,050,878 A 9/1991 Deleris
5,082,290 A 1/1992 Tucker et al.
5,160,135 A 11/1992 Hasegawa
5,178,388 A * 1/1993 Schlenker ..... 473/521
5,178,397 A 1/1993 Brine, Jr.
5,188,872 A 2/1993 Quigley
5,217,221 A 6/1993 Baum
5,219,166 A 6/1993 Chang
5,269,532 A 12/1993 Tucker et al.
5,303,916 A 4/1994 Rodgers
5,306,003 A 4/1994 Pagotto
5,312,100 A 5/1994 Ilacqua et al.
5,314,180 A 5/1994 Yamagishi et al.
5,333,857 A 8/1994 Lallemand
5,419,553 A 5/1995 Rodgors
5,421,574 A 6/1995 Yamagishi et al.
5,423,531 A 6/1995 Hoshizaki et al.
5,439,215 A 8/1995 Ratchford
RE35,081 E 11/1995 Quigley
5,478,647 A 12/1995 Miyamoto et al.
5,496,027 A 3/1996 Christian et al.
5,549,947 A 8/1996 Quigley et al.
5,556,677 A 9/1996 Quigley et al.
5,560,600 A * 10/1996 FitzSimons et al. ..... 473/463
5,577,725 A 11/1996 Pagotto et al.
5,582,405 A 12/1996 Montgomery
5,582,406 A 12/1996 Babcock
5,609,336 A 3/1997 Tashjian
5,636,836 A 6/1997 Carroll et al.
5,651,549 A 7/1997 Dill et al.
5,651,744 A 7/1997 Millon et al.
5,655,981 A 8/1997 Reed
5,676,608 A 10/1997 Christian et al.
5,685,791 A 11/1997 Feeney
5,685,792 A 11/1997 Ruoff
5,688,571 A 11/1997 Quigley et al.
5,718,647 A 2/1998 Tiitola
5,746,955 A 5/1998 Calapp et al.
5,827,141 A 10/1998 Lukey et al.
5,836,841 A 11/1998 Fell
5,839,977 A 11/1998 Maurer et al.
5,853,338 A 12/1998 Ubriaco
5,863,269 A 1/1999 Filice
5,865,696 A 2/1999 Calapp et al.
5,879,250 A 3/1999 Tahtinen et al.
5,888,601 A 3/1999 Quigley et al.
5,935,026 A 8/1999 Dill et al.
5,980,404 A 11/1999 Gentile
6,019,691 A 2/2000 Hilborn
6,033,328 A 3/2000 Bellefleur et al.
6,039,661 A 3/2000 Christian et al.
6,066,056 A 5/2000 Morrow
6,066,282 A 5/2000 Kramer
6,102,819 A 8/2000 Christian et al.
6,113,508 A 9/2000 Locarno et al.
6,117,029 A 9/2000 Kunisaki et al.
6,129,962 A 10/2000 Quigley et al.
6,152,839 A 11/2000 Heyduk
6,224,505 B1 5/2001 Burger
6,234,923 B1 5/2001 Gentile
6,241,633 B1 6/2001 Conroy
6,248,031 B1 6/2001 Brodie
6,257,997 B1 7/2001 Doble et al.
6,283,879 B1 9/2001 Eden et al.
6,352,485 B1 3/2002 Philpot et al.
6,361,451 B1 3/2002 Masters et al.
6,364,792 B1 4/2002 Evanochko
6,403,504 B1 6/2002 McMahon et al.
6,458,462 B1 10/2002 Kang et al.
6,500,079 B1 12/2002 Tucker, Sr.
6,547,683 B1 4/2003 Howgate
6,561,932 B2 5/2003 Morrow et al.
6,565,280 B1 5/2003 Post
6,663,515 B1 12/2003 Pai
6,723,134 B2 4/2004 Tucker, Sr.
6,910,976 B2 * 6/2005 Tucker, Sr. ..... 473/513
2002/0065154 A1 5/2002 Goldsmith et al.
2002/0093210 A1 7/2002 Sassone et al.
2002/0198070 A1 12/2002 Tucker, Sr.
2003/0045380 A1 3/2003 Tucker, Sr.
2003/0119612 A1 6/2003 Goldsmith et al.
2004/0053713 A1 3/2004 Morrow
2004/0072637 A1 * 4/2004 Morrow et al. ..... 473/513

FOREIGN PATENT DOCUMENTS

CA 1109091 * 9/1981
GB 1 589 596 7/1977
GB 2 274 067 7/1994
JP 7 39612 12/1995

OTHER PUBLICATIONS

International Search Report for International Application No. PCT/US04/026712, mailed from the International Searching Authority on Dec. 22, 2004. (3 pgs.).

* cited by examiner

LACROSSE STICK

TECHNICAL FIELD

The present invention relates generally to lacrosse sticks.

BACKGROUND

In the game of lacrosse, players use sticks to receive and shoot a ball. Lacrosse sticks generally include an elongated shaft and a head frame. The player grips a handle located toward the butt end of the shaft, and utilizes the head frame, which includes mesh, to receive and shoot the ball during play.

Decades ago, some lacrosse sticks were manufactured as one-piece, integral wooden structures. Such sticks were not only difficult and costly to fabricate, but owing to their unitary mechanical properties, also limited the maneuvers that a player could execute. For example, the stiff wood, while necessary for shaft strength, was poorly suited to the head frame; the lack of flexibility would, for example, limit the player's ability to scoop up the ball from the ground or make it more difficult for a player to receive a hard pass without feeling excessive vibrations.

As a result, it has become commonplace to fabricate lacrosse sticks using a shaft element formed of straight grained wood, or wood laminate, or a tough, lightweight metallic or reinforced plastic tubular element and to affix to the forward end of the shaft a flexible head frame (composed, for example, of a tough synthetic thermoplastic material such as high impact-strength nylon). Indeed, most lacrosse sticks today are sold as separate head and shaft portions.

A typical head frame for a lacrosse stick includes a socket to receive the forward end of the shaft. The shaft is then coupled to the head frame by a fastener, such as a screw. One problem with such a construction is that the connection between the head frame and shaft may loosen during play, compromising the player's ability to effectively control his stick. Worse, in some instances the head frame may detach entirely from the shaft.

Some lacrosse sticks exist that reinforce the connection between the head frame and the shaft to prevent disengagement of the head frame from the shaft. Unfortunately, regardless of reinforcement or attachment techniques, the head frame may still loosen or become detached over time. What is needed, then, is a lacrosse stick that integrates a head frame and a shaft into a unitary construction that does not become loosened or disengaged, but still retains flexibility in the head frame and rigidity in the shaft.

SUMMARY OF THE INVENTION

The invention provides a novel lacrosse stick having a rigid shaft with a terminal end, which may be forked or otherwise flared in certain embodiments. A flared end provides a larger area of contact with the molded flexible head frame than was possible with prior art devices. In fact, in one embodiment, the contact area may increase dramatically by overmolding the head frame directly onto the flared end of the shaft, thereby creating a unitary structure. Because of its structure, the lacrosse stick of the present invention is more durable than prior art devices, while still retaining the desirable rigidity in the shaft and flexibility in the head frame.

In one aspect, the invention relates to a lacrosse stick having a rigid terminal end, and a flexible head frame adapted to receive a mesh thereon, a portion of the head frame being overmolded onto the terminal end. The terminal end may be forked or otherwise flared. A forked end typically includes at least two tines, the head frame at least partially surrounding the tines so as to resist disengagement. A forked end may include at least one shoulder portion, the head frame at least partially surrounding the shoulder portion. Each tine may include a base, the head frame at least partially surrounding each base. Other embodiments of the stick further include a shaft, either forming a unitary structure with the forked end, or the mechanically engaging the forked end. Even in embodiments including a mechanical joinder, the problems of the prior art are avoided by, for example, ensuring that the throat of the fork is as rigid as the shaft it engages.

In another aspect, the invention relates to a lacrosse stick having a rigid forked end, and a head frame adapted to receive a mesh thereon, at least a portion of the forked end engaging at least a portion of the head frame. In certain embodiments, the head frame is mechanically joined to the forked end or overmolded onto the forked end to form a unitary structure. The head frame further includes a flexible distal end and a proximal end, wherein at least a portion of the forked end engages at least a portion of the proximal end of the head frame. The head frame may be symmetrical on opposite sides of an axis extending from the distal end to the proximal end, and forked end generally includes at least two tines diverging from the axis and positioned on opposite sides thereof. Other embodiments also include a shaft, such that the shaft the forked end are mechanically joined, and may include a sheath surrounding the joint of the shaft and the forked end. Such a sheath may be integral with the head frame. In another embodiment, the shaft and the forked end form a unitary structure.

In yet another aspect, the invention relates to a method of making a lacrosse stick, the method including the steps of providing a rigid element having a forked end, and overmolding a flexible head onto the forked end. The method may further include overmolding the connection of the rigid element and a second rigid element. The method may be utilized to overmold the flexible head onto tines and/or shoulder portions of the forked end. The base of the tines may also be overmolded.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
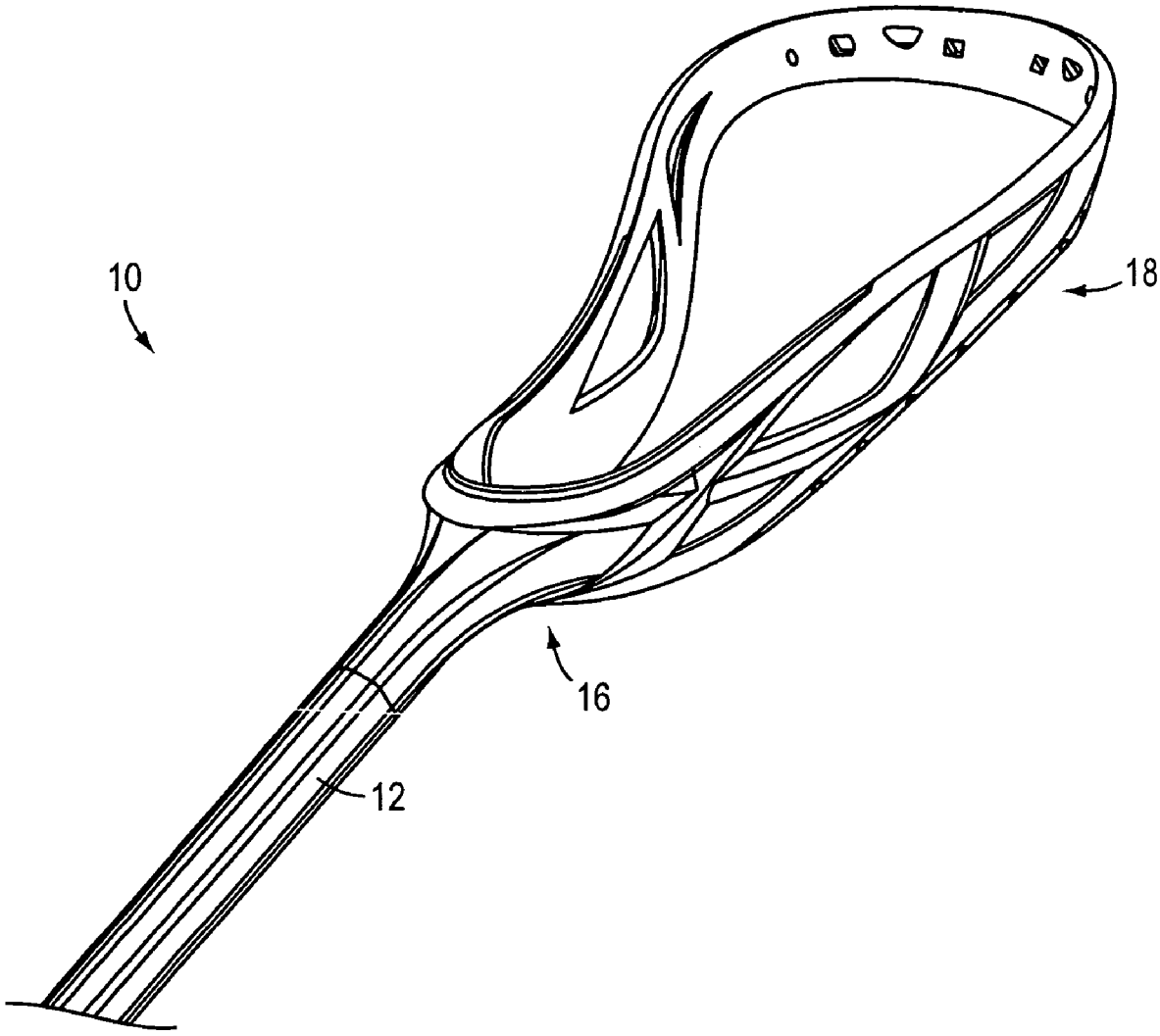
FIG. 1 is a perspective view of a lacrosse stick having an overmolded head frame in accordance with one embodiment of the invention.

Referring first to FIG. 1, which illustrates one embodiment of a lacrosse stick 10 in accordance with the invention. The stick 10 includes an elongate shaft 12, a butt end (not shown), and, in this embodiment, an integral forked end 16. A head frame 18 is overmolded onto the forked end 16.

Coupled to the butt end of the shaft 12 is a handle (not shown) which a player grips during use of the lacrosse stick 10. A variety of handles can be used in accordance with the invention. For instance, in one embodiment, the handle is a hollow rubber knob that slides onto and caps the butt end of the lacrosse stick 10. In another embodiment, the handle is an injection-molded plastic grip that slides onto the lacrosse stick 10 and has grooves designed to accommodate a player's fingers. Similarly, another handle may be located proximate the forked end 16 of the stick 10. Exact placement of the handle or handles may be determined by particular user needs or preferences, and the handle is not limited to those described; rather, it can be any handle that is typically used in a lacrosse stick or a hockey stick.

Figure 2A:
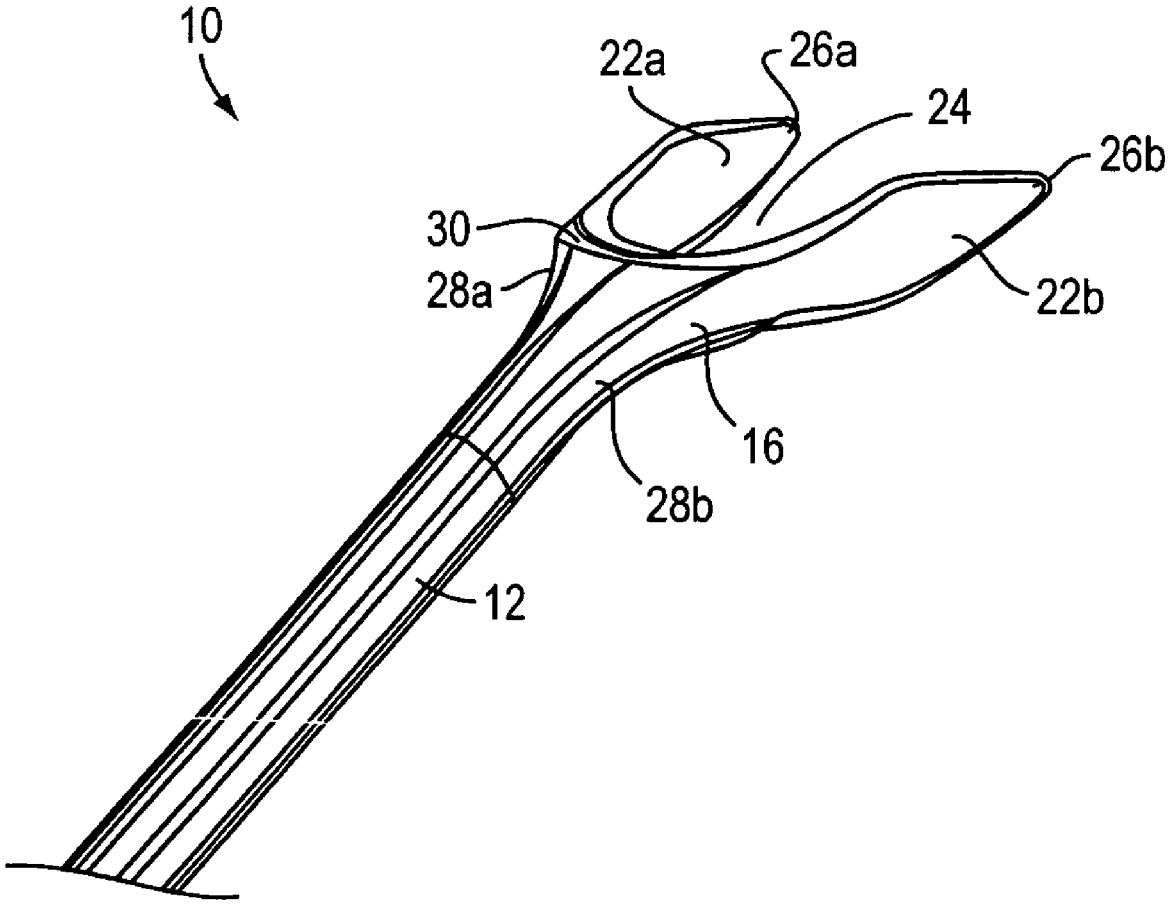
FIG. 2A is a perspective view of a shaft of a lacrosse stick having an integral forked end.
Figure 2B:
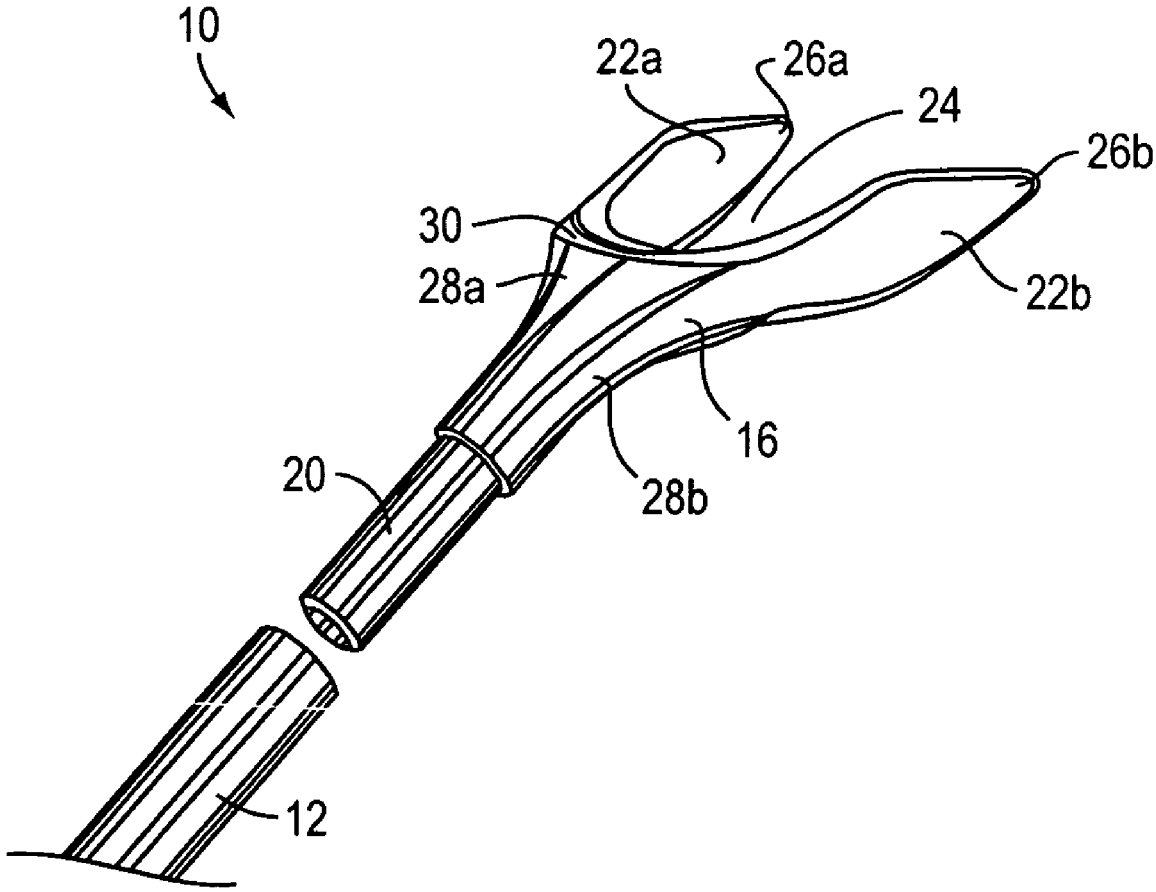
FIG. 2B is an exploded view of a shaft of a lacrosse stick having a discrete forked end.
Figure 3A:
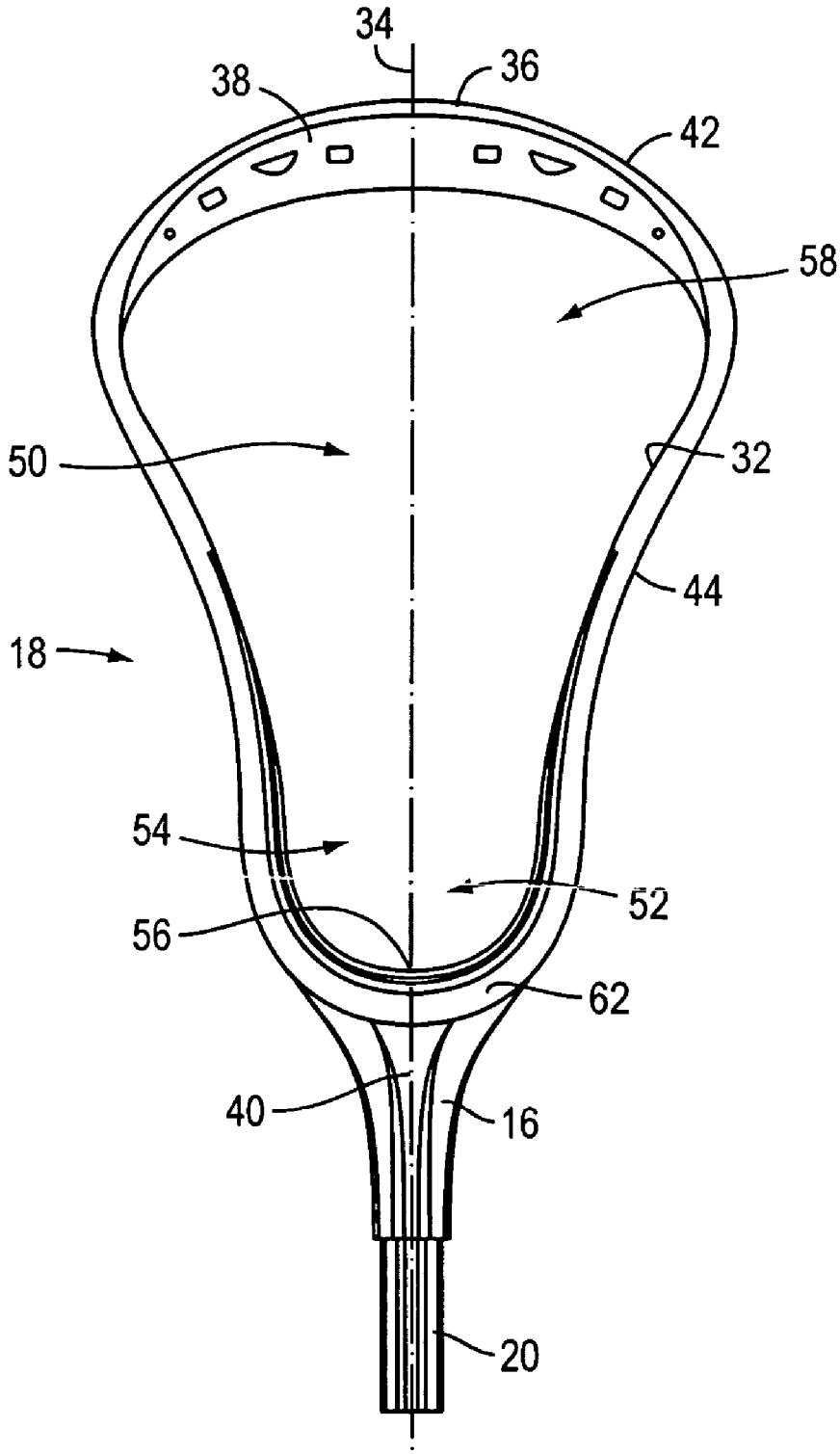
FIGS. 3A-3B are front and rear elevations, respectively, of an overmolded head frame in accordance with one embodiment of the invention.
Figure 3B:
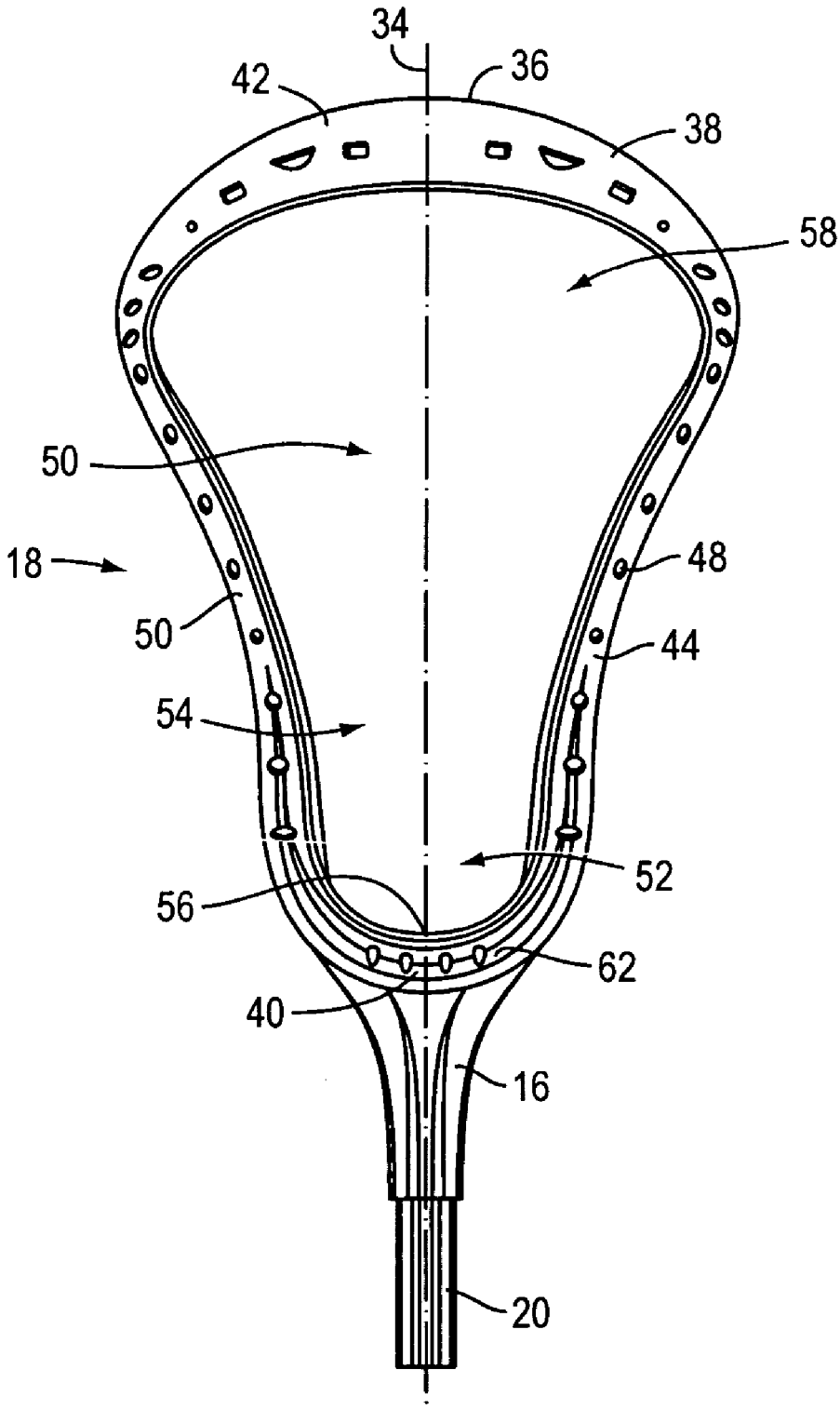
Figure 3C:
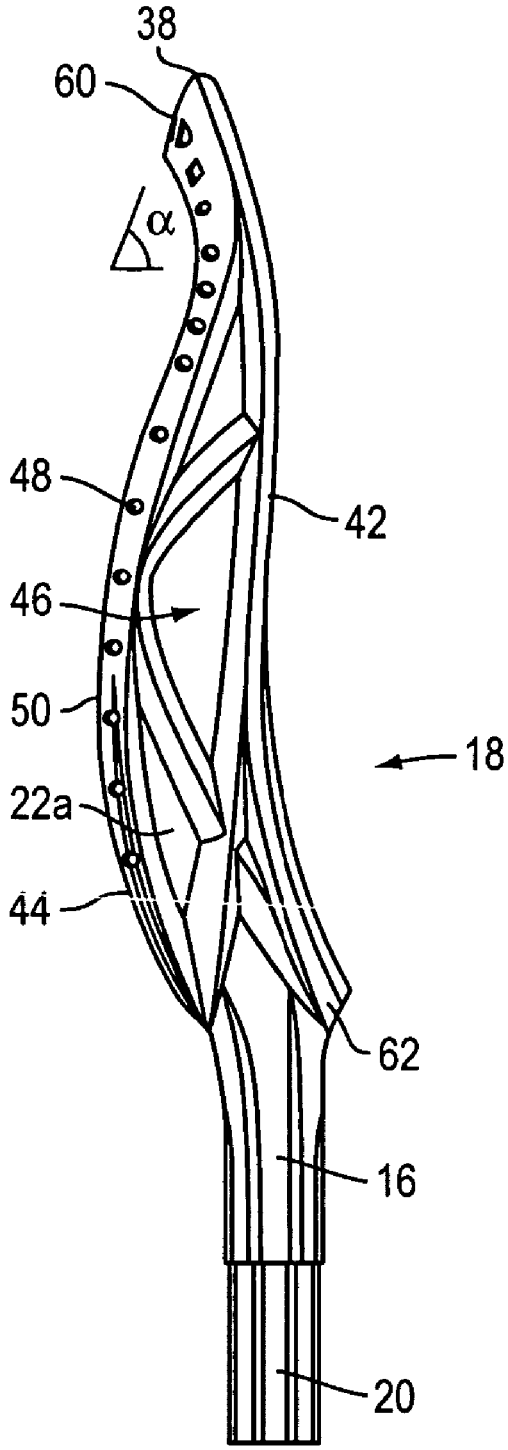
FIGS. 3C-3D are left and right side elevations, respectively, of the overmolded head frame of FIG. 3A.
Figure 3D:
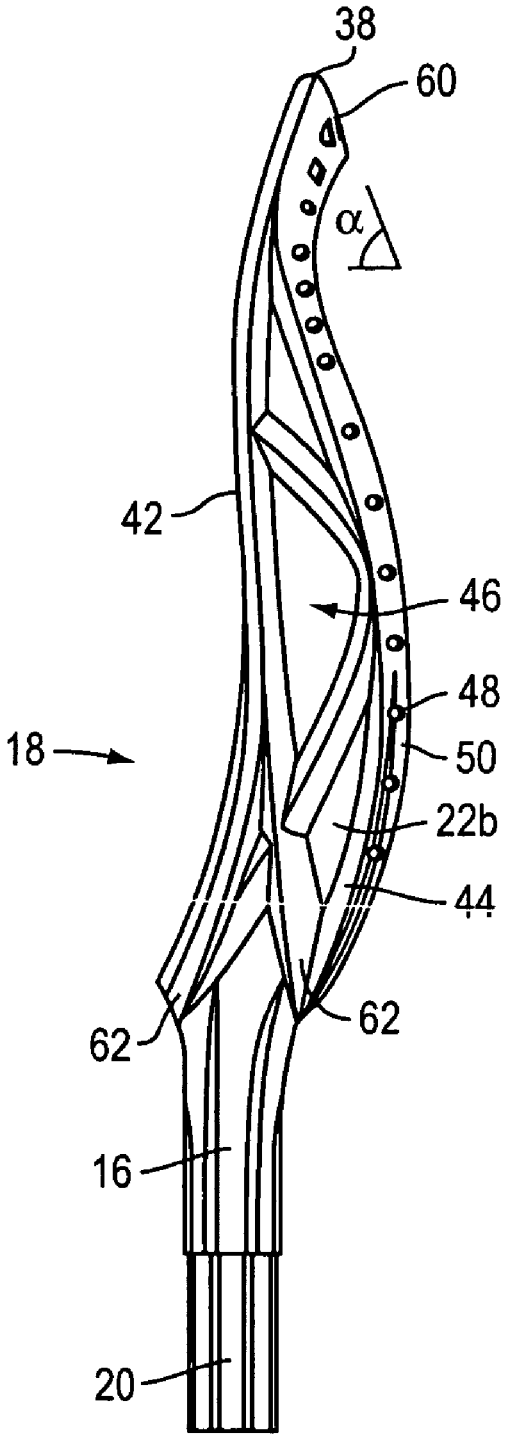
Figure 3E:
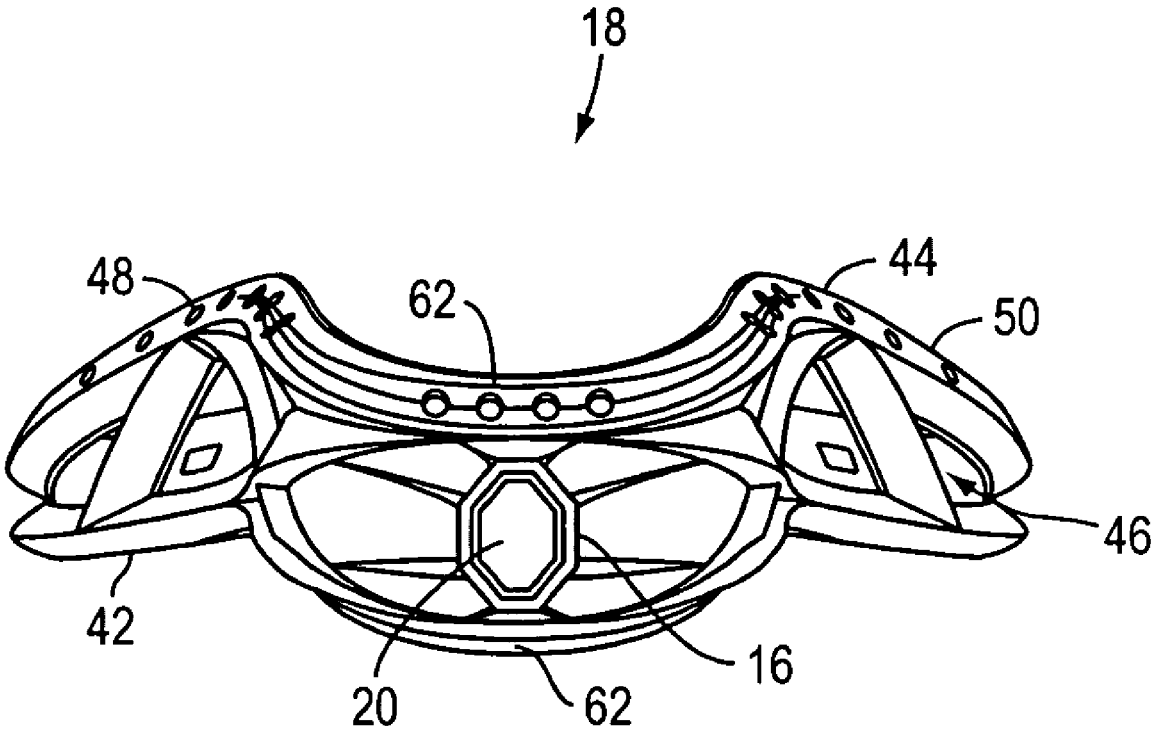
FIGS. 3E-3F are bottom and top elevations, respectively, of the overmolded head frame of FIG. 3A.
Figure 3F:
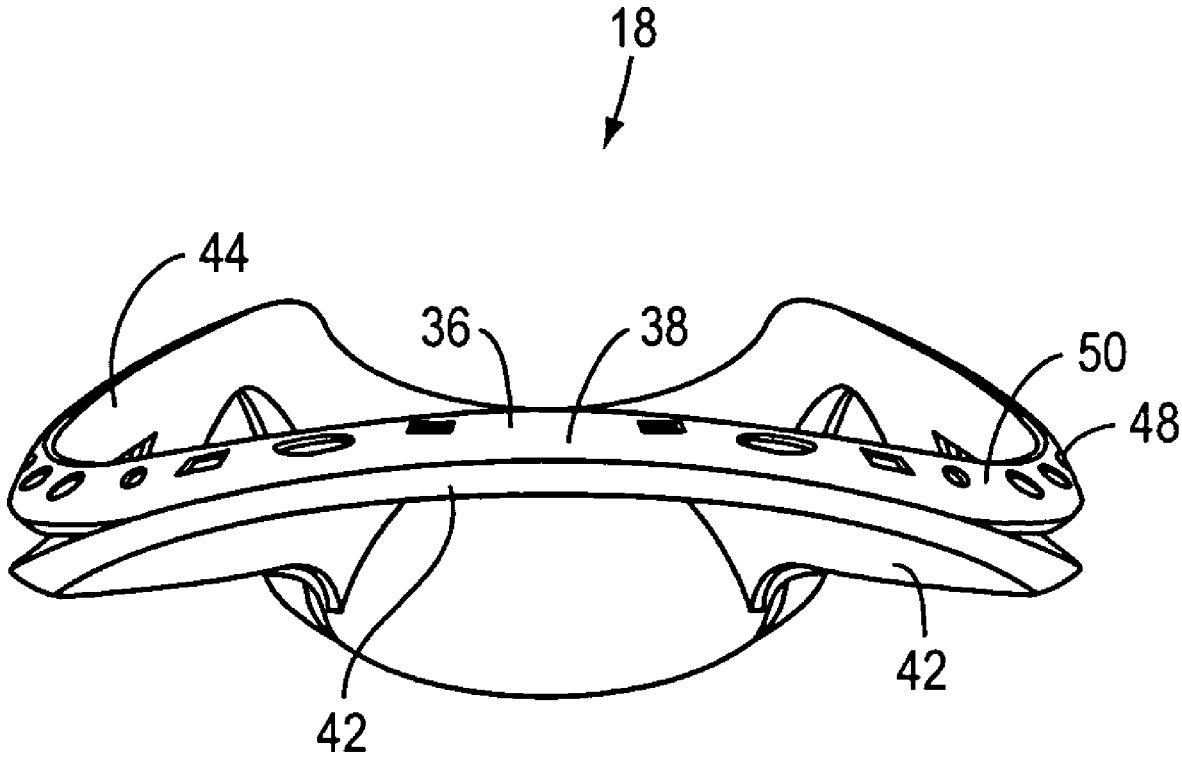
Figure 3G:
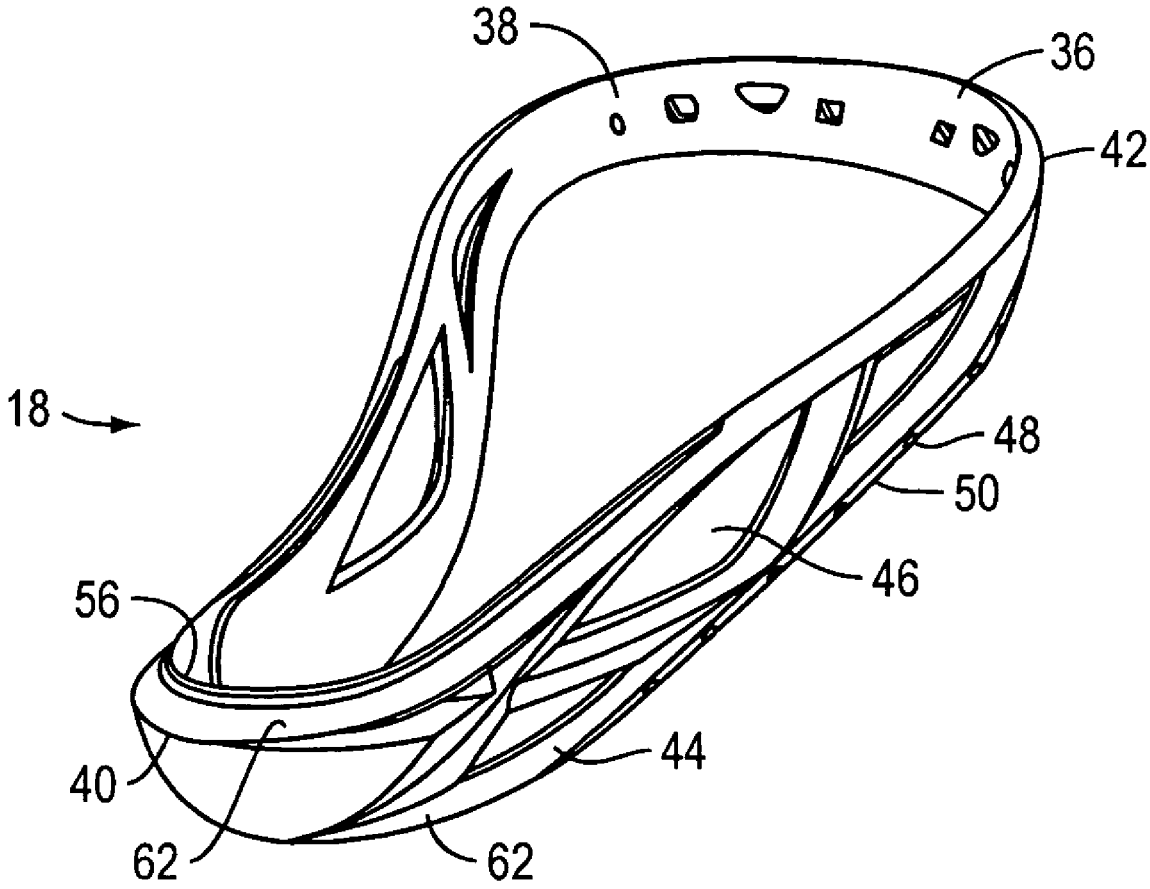
FIG. 3G is a perspective view of the overmolded head frame of FIG. 3A.

FIGS. 2A and 2B depict the stick 10 with the forked end 16 exposed. The forked end 16 can be integrally formed with the shaft 12 or, as depicted in FIG. 2B, may be a discrete element joined to the shaft 12. If the forked end 16 is discrete from the shaft 12, numerous ways to connect the two elements are available. For example, if a hollow shaft 12 is utilized, a male component 20 extending from the forked end 16 may be received within the body of the shaft 12. The component 20 may be secured with epoxy or other mechanical means such as screws or bolts. Regardless of connection method, a sheath (not shown) may be fitted over the point of connection to provide increased stability to the stick 10. In certain embodiments, the sheath may be integral with (or fully cover) one of the handle elements described above, or may be an extension of the head frame 18 as described below. Alternatively, or in addition, the shaft 12 may include a male component to be inserted into the forked end 16.

The forked end 16 includes at least two tines 22*a*, 22*b* that diverge from the terminal end of the shaft 12, forming a generally U-shaped or V-shaped opening 24. The tines 22*a*, 22*b* extend a predetermined distance from the shaft 12 and terminate at flat, pointed, round, or blunt ends 26*a*, 26*b*. The lengths of the tines 22*a*, 22*b* may vary, but generally should extend a sufficient distance to provide an adequate area of contact with the head frame 18, but not so far as to adversely effect the flexibility of the head frame 18. The thicknesses of the tines 22*a*, 22*b* may also vary with the distance from the base 28 of the tines 22*a*, 22*b*, or the tines 22*a*, 22*b* may have a uniform thickness along their entire lengths. The forked end 16 also may include one or more raised shoulders 30 at or near the base of the U-shaped opening 24. The shoulders 30 follow the contour of the frame 18 and aid in retaining an overmolded head frame, as described below.

As shown in FIGS. 3A-3G, the head frame 18 is defined by at least one wall member 32 extending from the forked end 16. Generally, the head frame 18 is symmetrical about a centerline axis 34. The distal end 36 of the wall member(s) 32 forms a generally arcuate nose element 38, which bridges the sides that converge towards the proximal end 40 of the head frame 18. The wall member 32 includes an upper rim 42 and a lower rim 44. The sidewall 46 between the two rims 42, 44 includes a plurality of openings to increase flexibility and to reduce weight. The lower rim 44 may have a plurality of apertures 48 spaced about its periphery to receive a mesh (not shown). In use, the mesh is suspended from the apertures 48 to define a bottom closure of the head frame 18. In another embodiment, the mesh is coupled to the head frame 18 by fasteners (not shown). In general, the mesh can be coupled to the head frame 18 using any suitable means.

The upper rim 42 of the head frame 18 defines a mouth 50 in which a lacrosse ball is received into and shot from the lacrosse stick 10. The mouth 50 is generally divisible into two functional portions. The first is a throat portion 52 adjacent the juncture of the wall member 32 with the forked end 16. The mesh suspended from the throat 52 of the head frame 18 defines a pocket 54, where the lacrosse ball resides during the player's retention of the ball in the lacrosse stick 10. The throat portion 52 of the head frame 18 terminates in an arcuate contour 56, the radius of curvature of the contour 56 being selected to define an accommodating surface against which the lacrosse ball rests while retained in the pocket 54. Typically, the contour 56 is lined with a soft, resilient padding which assists a player in maintaining the ball in the throat portion 52.

The mouth 50 also includes a receiving and shooting portion 58 defined by the portion of the mesh distal to the throat portion 52 and extending to the nose element 38 of the head frame 18. The receiving and shooting portion 58 where the lacrosse ball is initially received and entrapped by the player and from which the ball is ultimately passed or shot.

The nose element 38 of the head frame 18 has a generally flexible wall portion 42; for example, the wall portion 42 may be thinner than other portions of the wall member 32. The wall portion 60 is angled such that the upper rim 42 of the head frame 18 protrudes distally of the lower rim 44. The angle $\alpha$ (see FIGS. 3C and 3D) of the wall 60 can range from about 10° to about 80°. The thin, angled wall portion 60 of the nose element 38 assists a player in scooping a ball off the turf, since the flexibility of the wall portion 60 allows it to yield without excessive effort, sparing the player the need to lean excessively forward. Moreover, the wall portion 60 of the nose element 38 facilitates the fielding of ground balls since there is less of a lip for the ball to pass over before reaching the receiving and shooting portion 58.

The lacrosse stick of the present invention utilizes a large contact area between the forked end 16 and the head frame 18 to increase the connection strength between those two elements. In one embodiment, the two contacting elements, the forked end 10 and the head frame 18, are manufactured separately. Once manufactured, the proximal end 40 of the head frame 18 is inserted into the U-shaped opening 24 of the forked end 16. The sizes of the two elements, coupled with the complementary curvatures of the proximal end 58 and U-shaped opening 24, provide for contact along at least a portion of the length of the tine 22*a*, around the curvature of the U-shaped opening 24, and along at least a portion of the length of the second tine 22*b*. Naturally, if a V-shaped opening 24 is utilized, contact with the proximal end 40 of the head frame 18 may be limited, but sufficient contact area will still be present along the lengths of the tines 22*a*, 22*b* to prevent disengagement of the two elements 16, 18. To secure to the forked end 16 to the head frame 18, any suitable mechanical connectors such as screws, bolts, and the like may be utilized, but such connectors should be countersunk within the head frame to avoid interference with the lacrosse ball during play.

Increasing the number of such mechanical connectors will increase the strength of the overall device, as will utilizing an epoxy or other similar means of adhesion. Alternatively, an epoxy of sufficient holding strength may be utilized alone, in lieu of mechanical connectors.

Figure 4:
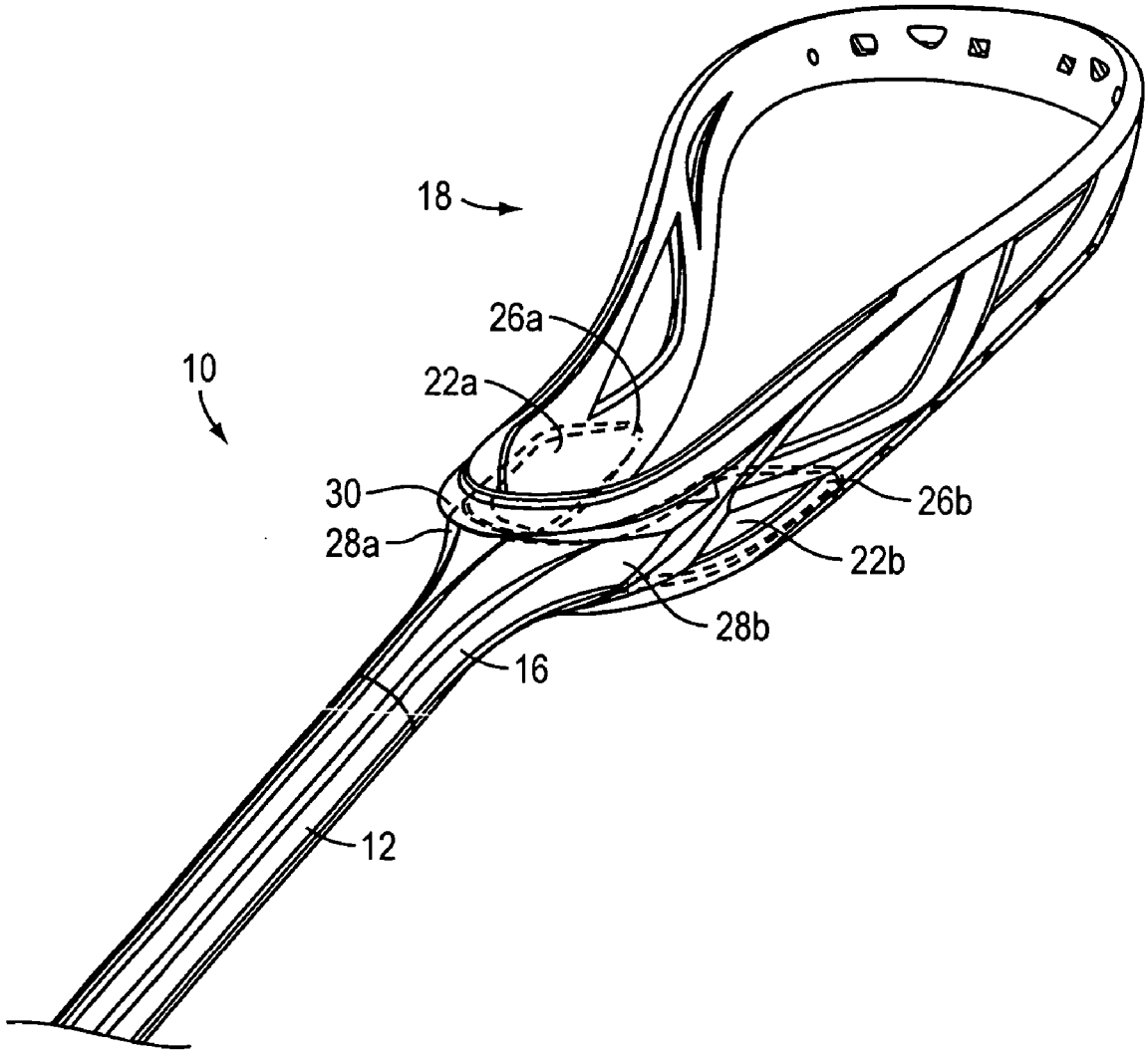
FIG. 4 is a perspective view of the lacrosse stick of FIG. 1 with the forked end visible through the overmolded head frame.

Another embodiment of the lacrosse stick utilizes a head frame 18 overmolded onto the forked end 16 as depicted in FIG. 4 (with the forked end 16 visible through the head frame 18). In such an embodiment, the forked end 16 is first manufactured, then placed in a mold (not shown) for the overmolding of the head frame 18. The overmolded head frame 18 is constructed such that it contacts at least a portion of the inner surface of the U-shaped opening 24, and at least a portion of the inner and outer surfaces of the tines 22*a*, 22*b*. Such a construction forms a unitary device that resists disengagement of the two main elements 16, 18 of the lacrosse stick 10. Similarly, additional wrapping portions 62 of the head frame 18 may be overmolded onto the shoulders 30 of the forked end 16 to further resist disengagement, even if the head frame 18 is pulled substantially in the direction of the shaft's axis.

Figure 5:
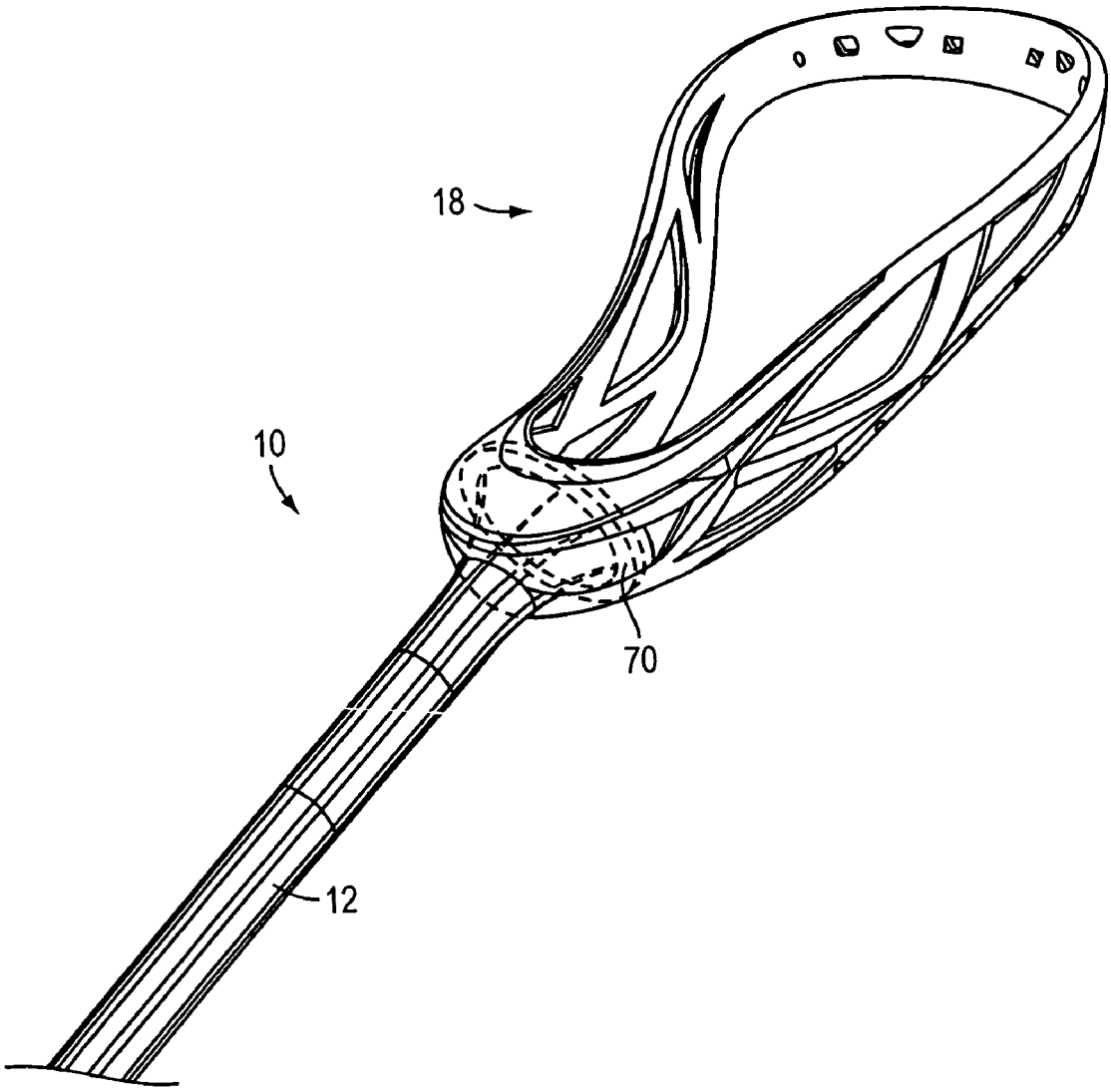
FIG. 5 is a perspective view of a lacrosse stick having a head overmolded onto a shaft terminating in a disk.
Figure 6:
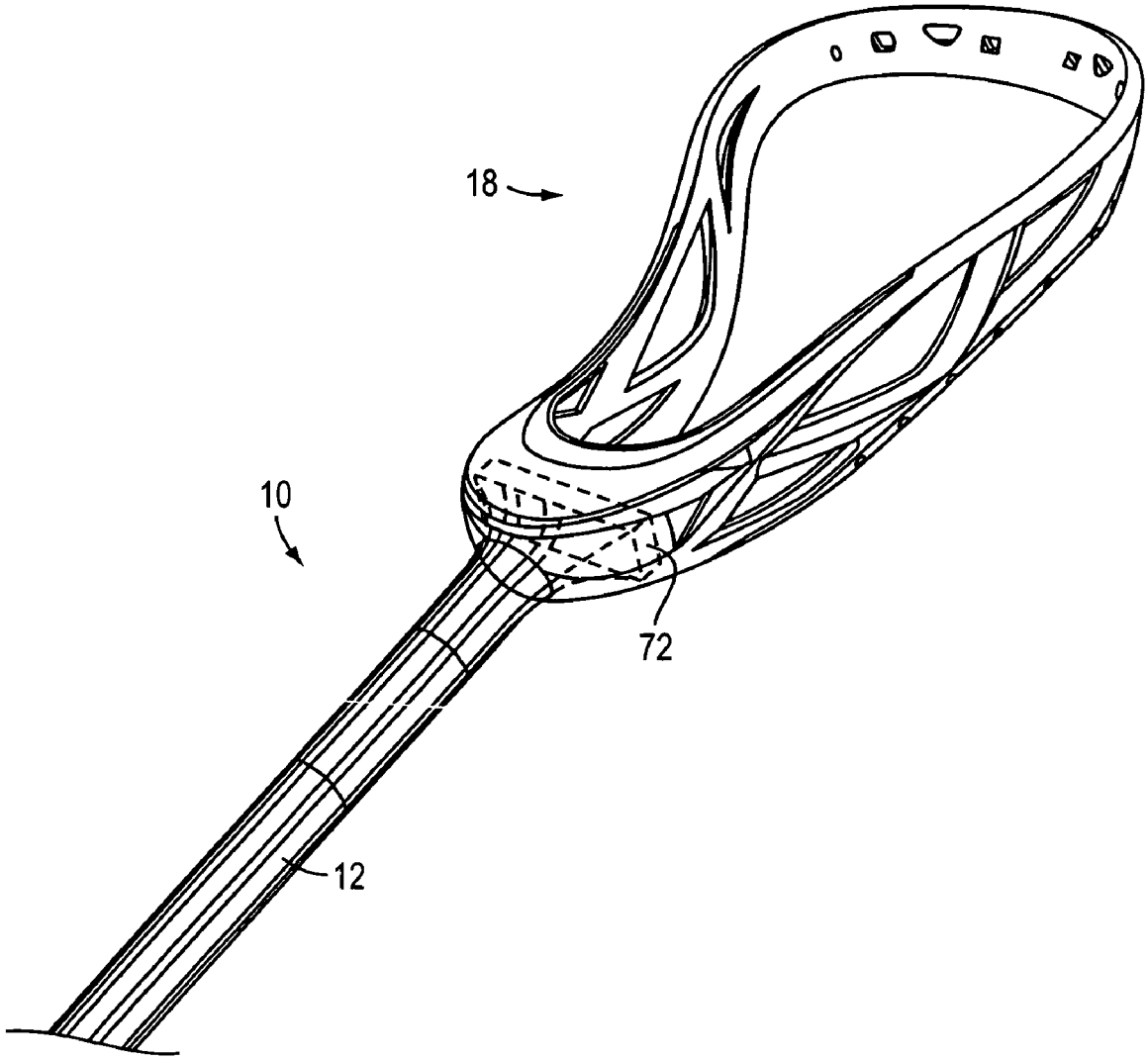
FIG. 6 is a perspective view of a lacrosse stick having a head overmolded onto a shaft terminating in a T-shaped end.

Alternatives to the forked end 16 are also possible. For example, as shown in FIG. 5, the shaft 12 may terminate in a flat, disk-shaped element 70 that has a diameter larger than the diameter of the shaft 12. This disk 70 may be integral with the shaft 12 or may be otherwise secured to the terminal end of the shaft 12. In this embodiment, the head frame 18 may be overmolded onto the disk and, if desired, a portion of the shaft 12 proximate the disk 70, thereby securing the head frame 18 to the shaft 12. In another embodiment illustrated in FIG. 6, the shaft 12 terminates in a T-shaped end portion 72. It will be understood that other flared terminal ends are also possible, the purpose being to increase the contact area between the head frame 18 and the terminal end of the shaft 12. Still other embodiments may incorporate one or more openings either completely or partially through the terminal end of the shaft 12. During overmolding, the head frame material may be introduced into the holes to secure the frame 18 to the terminal end.

Although the embodiment depicted in FIG. 1 shows the overmolded head terminating at the wrapping portions 62, alternative embodiments may extend the overmolding a predetermined distance along the length of the shaft 12. Such an overmold may extend to and/or beyond the bases 28*a*, 28*b* of either or both tines 22*a*, 22*b*. This may provide a more secure connection of the two elements 16, 18. Other overmolds may form a handle as described above, or may be used to reinforce the connection between the forked end 16 and the shaft 12. In the latter embodiment, the overmold functions effectively as a sheath over the point of connection of the forked end 16 and the shaft 12. With reference to FIGS. 1-2B, the lacrosse stick 10 has a shaft 12 and forked end 16 that are more rigid than the head frame 18. The shaft 12 and forked end 16 may be made from composite materials, which generally comprise a thermoplastic or thermoset polymer-based resin matrix impregnated with a material, such as a fiber, to reinforce the matrix. Exemplary fibers include glass, polymer arimides such as KEVLAR, carbon, boron, or ceramics. A composite may include two or more different types of fibers in a single matrix. In one embodiment, the shaft 12 and forked end 16 are molded (typically by injection molding) from a plastic material, for example, CAPRON polymer produced by Honeywell Plastics. To provide greater stiffness, a reinforcing material, such as KEVLAR or the like, may be overlaid onto the plastic material. Alternatively, the shaft 12 and forked end 16 may be manufactured from any durable, lightweight metal, such as titanium. Casting, tooling, or other techniques may be used to form the shaft 12 and forked end 16.

The head frame 18 may be made, for example, from a flexible plastic such as polyethylene or copolymers of polypropylene, or a durable synthetic thermoplastic material such as high impact-strength nylon. Materials such as ZYLON or ZYLON-based materials also display sufficient properties. Regardless of which material is used, generally, the head frame 18 material should be more flexible than the shaft 12, to allow the user to properly control the lacrosse stick 10 during play.

As indicated above, the particular configuration of the terminal end of the shaft allows for a greater area of contact between the head frame and the shaft, providing a more secure connection than that available in prior art lacrosse sticks. One embodiment of the invention utilizes overmolding to ensure adequate connection strength between those two components. The overmolding process generally includes placing a first finished component (here, a rigid shaft) into a second mold (here, a head frame mold). By molding the flexible plastic material over the terminal end of the more rigid shaft, a single unitary device made of two different materials is produced. This overmolding process mechanically traps the rigid end of the shaft within the flexible head frame once the head frame material cools and cures. This creates a strong structural bond, free of traditional mechanical fasteners such as screws, bolts, or adhesives, that securely joins the two components together. This process allows the head frame to effectively trap any shaft, regardless of terminal end configuration. The geometry of the two components, coupled with the overmolding, produces a final device that is difficult to separate into component parts. Also, because the two components are may be made of different materials, a unitary device having different properties is produced.

While there have been described herein what are to be considered exemplary embodiments of the present invention, other modifications of the invention will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the invention. Accordingly, what is desired to be secured by Letters Patent is the invention as defined and differentiated in the following claims.

What is claimed is:

1. A lacrosse stick comprising:

a rigid shaft comprising a forked terminal end; and a flexible head frame adapted to receive a mesh thereon, a portion of the head frame being overmolded onto the terminal end.

2. The lacrosse stick of claim 1, wherein the forked end comprises at least two tines, the head frame at least partially surrounding the tines so as to resist disengagement.

3. The lacrosse stick of claim 1, wherein the forked end comprises at least one shoulder portion, the head frame at least partially surrounding the shoulder portion.

4. The lacrosse stick of claim 2, wherein each tine comprises a base, the head frame at least partially surrounding each base.

5. The lacrosse stick of claim 1, wherein the shaft and the forked end form a unitary structure.

6. The lacrosse stick of claim 1, wherein the shaft is mechanically secured to the forked end.

7. The lacrosse stick of claim 1, wherein the terminal end defines at least one opening, at least a portion of the head frame being overmolded into the opening.

8. The lacrosse stick of claim 1, wherein the flared terminal end comprises a disk.

9. The lacrosse stick of claim 1, wherein the flared terminal end comprises a shaped member.

10. A lacrosse stick comprising:

a shaft comprising a rigid forked end, the forked end comprising first and second tines defining a U-shaped curvature therebetween; and a flexible head frame adapted to receive a mesh thereon, the head frame comprising a curvature complementary to the U-shaped curvature defined by the forked end, wherein the head frame engages the forked end entirely along the first tine, the U-shaped curvature, and the second tine.

11. The lacrosse stick of claim 10, wherein the head frame is mechanically joined to the forked end.

12. The lacrosse stick of claim 10, wherein the head frame is overmolded onto the forked end to form a unitary structure.

13. The lacrosse stick of claim 10, wherein the head frame further comprises a flexible distal end and a proximal end, at least a portion of the forked end engaging at least a portion of the proximal end of the head frame, and wherein the distal end is flexible relative to the forked end.

14. The lacrosse stick of claim 13, wherein the head frame is symmetrical on opposite sides of an axis extending from the distal end to the proximal end, wherein the two tines diverging from the axis and are positioned on opposite sides thereof.

15. The lacrosse stick of claim 10, wherein the shaft is mechanically secured to the forked end.

16. The lacrosse stick of claim 15, further comprising a sheath surrounding a joint of the shaft and the forked end.

17. The lacrosse stick of claim 16, wherein the sheath is integral with the head frame.

18. The lacrosse stick of claim 10, wherein the shaft and the forked end form a unitary structure.

19. A method of making the lacrosse stick of claim 1 or claim 10, the method comprising the steps of providing a first rigid element comprising a forked end, and overmolding a flexible head onto the forked end.

20. The method of claim 19, further comprising the step of connecting the first rigid element to a second rigid element.

21. The method of claim 19, wherein the step of overmolding the head onto the forked end further comprises overmolding the connection of the first rigid element and the second rigid element.

22. The method of claim 19, wherein the forked end comprises at least two tines.

23. The method of claim 21, wherein each tine comprises a base.

24. The method of claim 19, wherein the forked end comprises at least one shoulder portion.

* * * * *